United States Patent [19]

Sniderman

[11] 4,034,980

[45] July 12, 1977

[54] MAGNETIC GAME BOARD AND PLAYING PIECES

[76] Inventor: Ken Edward Sniderman, 1930 Riverside Drive, Apt. 1-B, Trenton, N.J. 08618

[21] Appl. No.: 677,970

[22] Filed: Apr. 19, 1976

[51] Int. Cl.[2] ..... A63F 3/00

[52] U.S. Cl. ..... 273/131 AD; 273/136 B

[58] Field of Search ..... 273/131

[56] References Cited

U.S. PATENT DOCUMENTS

| | | | |
|---|---|---|---|
| 2,819,904 | 1/1958 | Nelson et al. | 273/131 AD UX |
| 3,625,514 | 12/1971 | Haaland | 273/131 AD X |

*Primary Examiner*—Delbert B. Lowe
*Attorney, Agent, or Firm*—Behr & Woodbridge

[57] ABSTRACT

A game board having two playing surfaces each symmetrically divided into a plurality of like regions which are arranged to form rows, columns, and diagonals of the regions in the fashion of a checkerboard. The game is played by moving pieces having bar magnets therein about the regions. Some regions have bar magnets thereunder which either repel or attract the pieces. The game provides for automatic, in place, flipping of pieces which are repelled and for reprogramming of the positions of the magnets in the board.

12 Claims, 4 Drawing Figures

MAGNETIC GAME BOARD AND PLAYING PIECES

BACKGROUND OF THE INVENTION

1. Field of the Invention

This invention relates to a checkerlike game embodying a game board having board magnets therein and movable game pieces having piece magnets therein and involves interactions between the board magnets and the piece magnets.

2. Description of the Prior Art

It is known to place bar magnets and magnetic pieces in permanently closed boxlike structures. Structures exist wherein laterally spaced magnets have their poles orthogonal to a permanently closed housing. This is exemplified by magnetic credit cards and the techniques developed for their manufacture. See U.S. Pat. No. 3,651,312 issued on Mar. 21, 1972 to W. W. Barney.

Barney does not disclose a housing which can be reopened. Moreover, Barney does not address the problem of reprogramming the positions of a plurality of magnets with respect to a fixed peripheral geometry for the housing, a credit card.

As known, a magnetic game comprises a flat board having a SINGLE playing surface and checkerlike playing pieces. The board is square and is divided into a plurality of playing squares in a checkerboard fashion with squares arranged in rows, columns, and diagonals. Alternate diagonals of squares are colored differently. One set of alternate diagonals of squares, the playing squares, has under EACH square a bar magnet with either an N-pole or an S-pole proximate to the playing surface. Players of a game on this board having found games less and less interesting and appealing as the game is repeated because they tend to learn the relative positions of opposite polarity squares of the board. This information is acquired when a piece is not repelled by one square but is repelled by another. See U.S. Pat. No. 2,819,904 issued on Jan. 14, 1958 to W. M. Nelson et al.

Such games, as known, are played with cylindrical playing pieces which have two flat surfaces. These pieces have magnets imbedded therein without regard or reference to a color difference on the flat surfaces. Each magnet has an S-pole and an N-pole. In one portion of the playing pieces, the S-poles are adjacent first colored surfaces. In a remaining portion, the N-poles are adjacent first colored surfaces.

The board, as known, is flat and has a magnet located under each square which is used for playing. One symmetric portion of the board, for example, the alternate diagonals, is used for play. This portion may be colored red, for example, and an unplayable portion may be colored black, for example. The board magnets are located under each square with either an S-pole or an N-pole adjacent thereto. The S-poles and N-poles are arranged in a symmetric pattern. See U.S. Pat. No. 2,819,904 supra. One problem with this arrangement is that when a face of the cylindrical playing piece of one polarity lands on a square having underneath a pole of the same polarity the piece is not only repelled but is either translocated to another square or to its curved wall. Thus, the player must manually flip over the playing piece. This is an annoying inconvenience which substantially slows the pace of the game.

Another problem with the game as known is the permanent site of each individual magnet in the board.

This lack of flexibility and lack of programmability for the board reduces the commercial value of the game. What is needed is a variation of this game wherein the degree of skill necessary to play the game may be selected by selection of a particular program for the board, i.e., a pattern for the various combinations of S-poles and N-poles of board magnets which may be placed adjacent a surface of the board.

Flexibility in programming is not itself the only problem to be solved. A means is needed to quickly change the pattern of the board without the necessity of rearranging individual magnets within the board. An automatic or semi-automatic means is needed for changing the pattern. Considerable consumer interest is expressed for those games wherein several elements of a game or toy are remotely changed by one manual movement.

SUMMARY OF THE INVENTION

The inventions are a means for automatically flipping the playing pieces of the game, the means comprising spherical balls and spherical cavities in the playing squares; a game board having a magnet pattern which is changeable by reorienting the board; and a game board having a magnet pattern which is changeable by removing, adding, translocating, and flipping individual magnets therein.

DESCRIPTION OF THE PREFERRED EMBODIMENT

Figure 1:
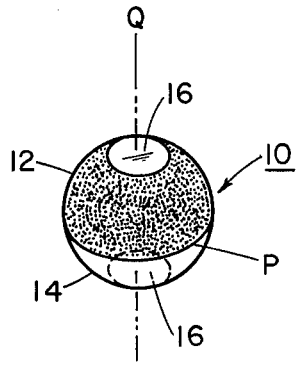
FIG. 1 is a perspective view of a novel playing piece for this invention.

Shown in FIG. 1 is playing piece 10. The playing piece 10 comprises two outer parts of a shell. A rough textured part is a half 12 of the piece 10. The half 12 may also be made to exhibit as first color, red, for example, whereas another part of the shell may be made to exhibit a second color, white, for example. Another half 14 of the piece 10 is smooth textured and fits snugly against the half 12 to form a spherical body. Each half, 12 and 14, is designed with a concentric flat face 16 thereon.

Figure 2:
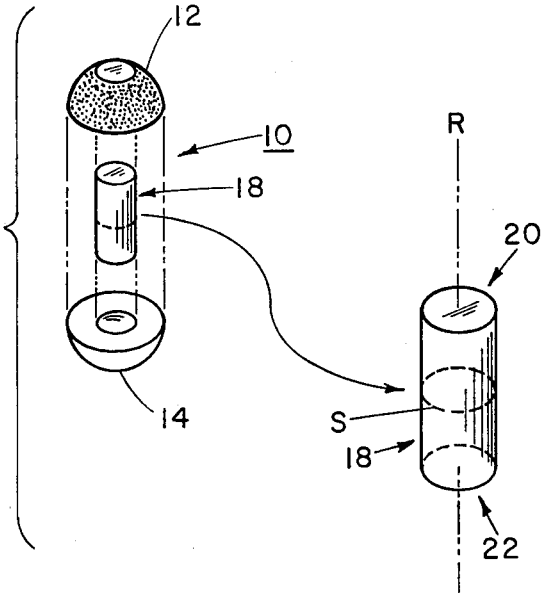
FIG. 2 is a fragmented perspective view of the novel playing piece of this invention.

As illustrated in FIG. 2, each playing piece 10 is held together by any suitable means such as a cylindrical member, for example. The cylindrical member in the present embodiment is a magnet 18 having opposite poles 20 and 22. Poles 20 and 22 may be north poles and south poles, respectively. Usually these poles are designated "N-" and "S-", respectively.

The piece 10 is generally describable as comprised of two halves 12 and 14 which exhibit mirror symmetry with respect to each other as to their shape. In fact, they are mirror symmetric about an imaginary plane at their juncture. This means that a half 12 placed at the plane P projects the shape of the other half 14 into the plane P provided the plane P is a reflecting mirror.

The flat faces 16 of the halves 12 and 14 are further arranged such that they are parallel to the plane P and concentric with an imaginary principal symmetry axis Q of the piece 10. The axis Q is therefore orthogonal to the plane P and flat faces 16.

The magnet 18 has a principal longitudinal symmetry axis R. When the piece 10 is manufactured and assembled axis R is coincident with the axis Q. The plane P then bilaterally traverses the magnet 18. The plane P is generally referred to as a mirror-symmetric internal plane of the piece 10. The magnet 18 is mirror-symmetric about the imaginary plane S. When piece 10 is assembled the plane S is coincident with the plane P. The axis R is referred to as an internal principal symmetry axis.

The game is played with a plurality of pieces 10, for example ten pieces, assembled according to FIG. 2 to appear as shown in FIG. 1. The plurality is assembled such that one pole of the piece magnet 18, for example an N-pole, is located in the first half 12 in a preselected number of the pieces 10, for example seven pieces, and such that the other poles of the remaining piece magnets 10 are located in the second half 14.

A portion of the pieces 10, for example one-half or five, are provided for one player. This portion is placed on a playing board with a first mirror-symmetric half, for example half 12, oriented away from the board. The remaining pieces 10 have their second mirror-symmetric half, for example half 14, located away from the board and are provided for another player.

A plurality of persons play the game on a board 30. The board 30 comprises a solid molded upper frame 32, a solid molded lower frame 34, a field plate 36, and a plurality of board magnets 38.

The upper frame 32 has an opening 40 which is adapted to receive a protruded part 42 of the lower frame 34. The part 42 is press fitted into the opening 40 and the board 30 is held together by friction between the upper frame 32 and the lower frame 34, the field plate 36 being held therebetween.

A first surface 44 of the board 30 is divided into a plurality of spaces, for example squares 46 and squares 48. The squares 46 are distinguished from the squares 48 by a color difference. The squares 46 may be colored white, for example, and the squares 48 may be colored red, for example. The game is played on either of the sets of squares 46 and 48. Thus, the playing squares used for a game are alternate linear squences of playing squares, for example sequences 50 anf 52, which are diagonally oriented with respect to an edge 54 of a surface, which in this example is the surface 44.

Another method of distinguishing the squares 46 from the squares 48 is to provide a difference in texture such as a smooth surface for the squares 46 and a rough surface for the squares 48.

A carity 60 is located in each of the playing squares 46 and 48, preferably in the center thereof. The cavity 60 is a spherical depression in the upper frame 32 with a flat face 62 located as a surface thereof. Each cavity 60 has an aperture 64 on the surface 46 or 48. A periphery of the flat face 62 is concentric with the periphery of the aperture 64.

The cavity 60 has a surface which is comprised of the flat face 62 and a spherical wall 66. The wall 66 is preferably shaped and adaptd to receive either half 12 or 14 of the piece 10.

The field plate 36 is comprised of a material which attracts both poles 20 and 22 of magnets 18. It is shaped and adapted to fit only under all of the peripheral squares of the game board. The upper frame 32 has four edges 54, 72, 74 and 76. The field plate 36 lies under the playing squares 46 and 48 adjacent these edges. Similarly, like playing squares on a surface 78 of the lower frame 34 which are adjacent edges 80, 82, 84, and 86 thereof underlie the field plate 36.

The lower frame 34 is adapted to receive the plate 36 around the periphery 88 of the protruded part 42, the plate 36 being adapted to lie on a flat surface 90 of the frame 34 and a flat surface 92 of the upper frame 32 being adapted to lie on the plate 36. A cavity 40 in the upper frame 32 is adapted to receive the protruding part 42.

The surface 78 of the lower frame 34 is similar to the surfce 44 of the upper frame 32 and has like cavities therein and like squares thereon. The squares 46 and 48 on surface 78 may be similarly colored or textured or differently colored or textured.

The protruded part 42 of the lower frame 34 has openings 94 therein which are adapted to receive the magnets 38. The openings 94 have apertures 96 at the surface 98 of the frame 34. Any opening 94 receives all of a magnet 38. Hence, one flat surface 100 of the magnet 38 is flush with an aperture 96 and proximate to an adjacent flat face 62 on the surface 44 of the frame 32. The corresponding opposite flate surface 100 on the magnet 38 is adjacent a similar flat face 62 on the surface 78.

The game may be played by first linearly arranging four pieces 10 in like squares 46 adjacent one edge 76, for example, and four pieces in like squares 46 adjacent another edge 72, for example. Alternate moves, of each player's own pieces, by each player are made to a different like square 46 until either a first player's pieces 10 are all in the original location of a second player's pieces 10 or all of the first player's pieces have been flipped so that another half 12 or 14 is showing. Either the first player or the second player may move first to commence the game.

The pieces 10 are equipped with an outer housing which is adapted to be spherical and received by the cavities 60 such that they are flipped and repositioned in the cavity 60 when an opposite pole of a magnet adjacent a flat face 62 is encountered by a half 12 or 14 of a piece 10.

The pattern of the board 30 may be changed, i.e., the positions of the magnets 38 relative to an edge, such as 54, in front of or associated with a player. This is designed into the board by purposefully not placing magnets 38 adjacent all of the squares 46 and 48. The magnets 38 are placed adjacent some of both the squares 46 and the squares 48 in an asymmetric pattern. The pattern is therefore semi-automatically changed with respect to a player by rotating the board about an axis orthogonal to a surface 44, for example $n/2$ pi radians where $n$ is not a multiple of 4. This feature of the board is predicated upon the player being stationary with respect to the board.

There are two like surfaces 44 and 78 of the board 30. Because the magnets 38 are heteropolar, i.e., have different poles, an "S–" pole and an "N–" pole, for example, when one pole is adjacent a flat face 62 of the frame 32 the other different pole is adjacent the opposite face 62 in the frame 34. Thus, when the board 30 is flipped over such that the surface 78 is used for play a new and different pattern is present.

Various combinations of flips and rotations of the board 30 may be selected to achieve a new pattern or program. With the magnets 38 fixed a total of eight different patterns may be used.

The board 30 has a novel design which further permits the locations of the magnets 38 with respect to each other to be changed to give a virtually unlimited variety of patterns or programs. The frames 32 and 34 are frictionally held together and are openable and reclosable whereby the magnets 38 are removable, reorientable in their openings 94, rearrangeable, and replaceable. As a further means of changing the pattern or program additional magnets may be added.

Figure 4:
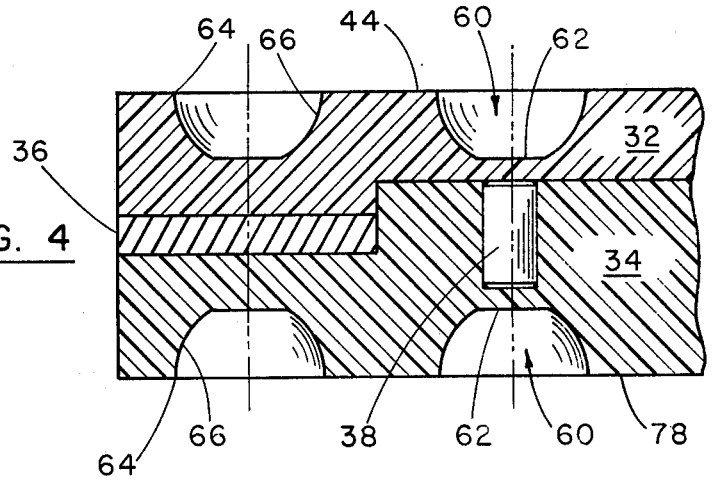
FIG. 4 is a partial cross section taken along the line 50—50 of FIG 3.
Figure 3:
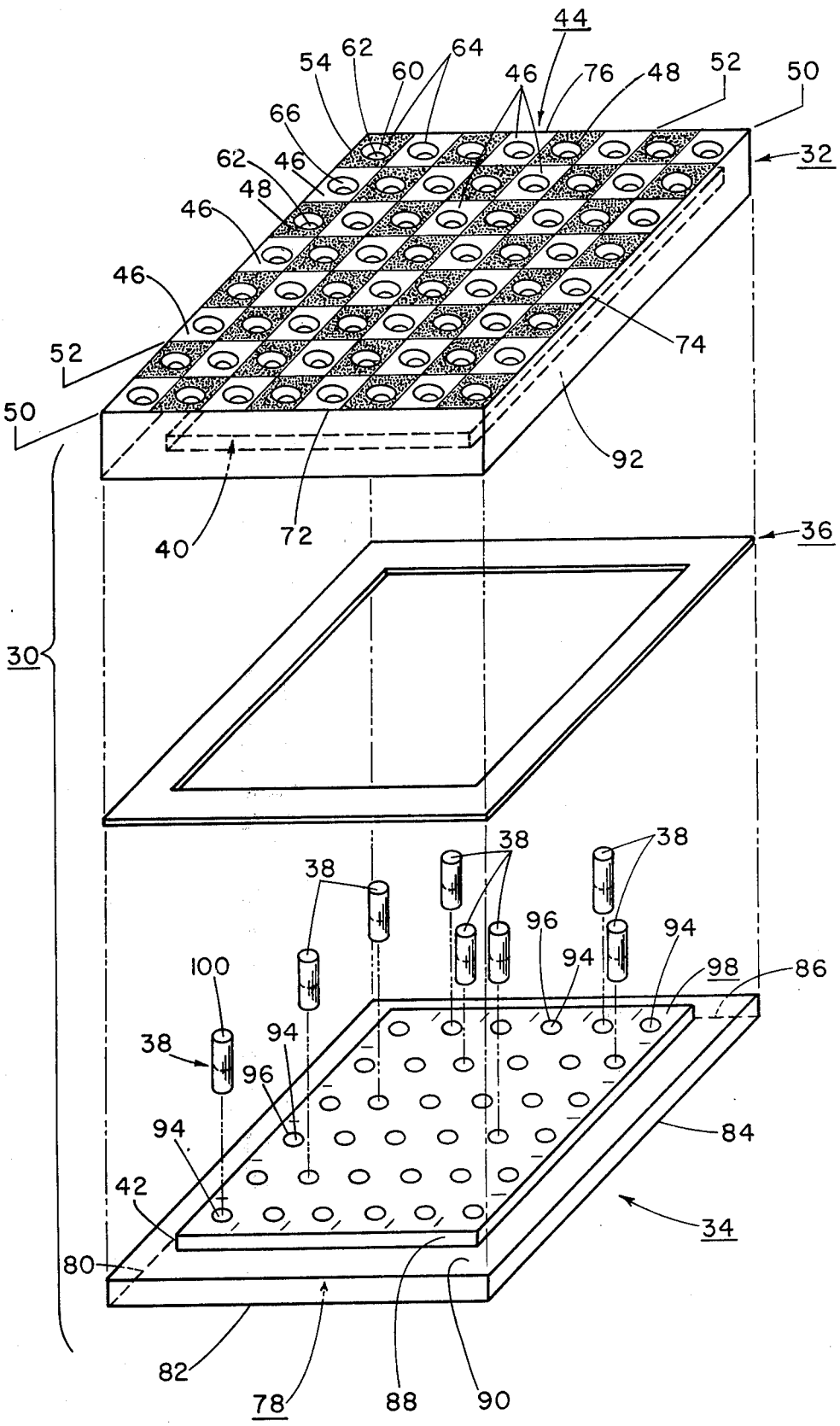
FIG. 3 is a fragmented perspective view of a novel playing board of this invention.

FIG. 4 provides a cross-sectional view of the assembly of FIG. 3. Shown there is a partial section of the upper frame 32 and a partial section of the lower frame 34 along the line 50—50. The flat faces 62 of the cavities 60 are adjacent faces of the magnet 38. As shown, cavities 62 are on each surface 44 and 78 and concentric with an underlying magnet 38 or cavity 94.

The invention is predicated upon a greater frictional resistance to the motion of the piece 10 with respect to the surface 66 of the cavity 60. When the flat 16 is congruent with and adjacent the flat 62 of the cavity 60, The firctional resistance to a movement of the playing piece 10 is greatest. At other positions of the piece 10 with respect to the cavity 60, only one spot on the piece 10 is touching the flat 62 and a coincidence of the surface of the piece 10 with the periphery 64 of the cavity forms a line of contact resembling an arc. The inventor has experimentally determined that when like poles are adjacent the face 16 and the face 62, during contact, movement of the piece 10 by a repelling magnetic force raises the piece 10 and decreases the frictional resistance enabling the piece 10 to flip to a more stable mechanical position wherein another face 16 with an opposite underlying pole positions itself adjacent the face 62. Experiments with a completely spherical piece and a spherical cavity adapted to receive said piece have resulted in inadequate and asymmetric repositioning of the piece.

What is claimed is:

1. In a two player game comprising a game board comprising two principal parallel surfaces, the game board having a plurality of equidistantly spaced cavities arranged in longitudinal and lateral rows therein, board magnets being positioned in at least a portion of the cavities, each magnet having two oppositely oriented poles oriented orthogonal to said surfaces, one said surface being divided into a plurality of playing squares, each board magnet underlying a square, a plurality of game pieces, the game pieces each having a first mirror-symmetric half, having a means thereon for distinguishing from a second mirror-symmetric half, each game piece exhibiting a first mirror-symmetric internal plane and an internal principal symmetric axis and comprising a piece magnet having two poles, the piece exhibiting a second mirror-symmetric body plane and a second internal principal symmetric axis, the first plane coinciding with the second plane, the first axis coinciding with the second axis, one pole of said piece magnet being located in said first half in a preselected number of spaces, the other pole of said piece magnet being located in said second half in the remaining pieces, a portion of the pieces with the first mirror-symmetric half oriented away from the board being provided for one player, the remaining pieces having their second mirror-symmetric half oriented away from the board and being provided for another player, an improvement comprising:

the second surface of said board being divided into a plurality of playing squares congruent with the squares of the first surface;

the board magnets being asymmetrically positioned and located only in some of said cavities;

the game being playable on either surface of the board at any edge of the board, the position of the board magnets with respect to a player located at an edge of a surface being changeable by either rotating or inverting the board whereby an increased element of chance is present in the game.

2. The combination receited in claim 1 further comprising means for automatically flipping and repositioning said pieces when a pole of a board magnet is encountered by a like pole of the half adjacent the surface.

3. The combination recited in claim 2 wherein said means comprises recessions in each playing square of alternate linear sequences of playing squares diagonally oriented with respect to an edge of one surface and corresponding recessions in each opposite playing square of the other surface, said recessions each having a flat bottom and each being adapted to receive one mirror-symmetric half of a piece, and wherein said means further comprises a spherical housing for each piece, said housing having flattened regions thereon concentric with a magnetic field provided by each pole of a piece magnet.

4. The combination recited in claim 3 further comprising a metallic field plate adjacent the bottom of the playing squares located adjacent the edges of the board.

5. The combination recited in claim 4 wherein said means for distinquishing said first mirror-symmetric half of a piece from said second mirror-symmetric half of a piece comprises a rough texture on the first half and a smooth texture on the second half.

6. The combination recited in claim 4 wherein said means for distinguishing said first mirror-symmetric half of a piece from said second mirror-symmetric half of a piece comprises a color difference.

7. A reprogrammable magnetic game board for use with playing pieces having magnets therein, comprising two opposite playing surfaces, a hollow openable and reclosable housing having upper and lower board members, each member having a plurality of equidistantly spaced apart openings therein, adapted to detachably receive magnets therein, the magnets having two oppositely oriented poles oriented orthogonal to said surfaces and removably located in said openings, the surfaces being divided into a plurality of playing squares, each magnet underlying a square whereby differing arrangements of the magnets within a playing field are obtainable.

8. The game board of claim 7 wherein said surfaces further comprise recessions, adapted to receive said playing pieces.

9. The game board of claim 8 wherein said recessions have walls of spherical curvature.

10. The game board of claim 9 wherein said recessions have circular flattened regions substantially centrally located therein.

11. The game board of claim 8 wherein every other said diagonally oriented linear sequence of playing squares on a surface is rough textured and each remaining diagonally oriented linear sequence of playing squares on said surface is smooth textured.

12. In a two player game comprising a game board comprising a principal surface, the game board having a plurality of equidistantly spaced apart cavities arranged in longitudinal and lateral rows therein, board magnets being positioned in the cavities, each magnet having two oppositely oriented poles oriented orthogonal to said surface, the surface being divided into a plurality of playing squares, each board magnet underlying a square, a plurality of game pieces, the game pieces each having a first mirror-symmetric half, having a means thereon for distinguishing from a second mirror-symmetric half, each game piece exhibiting a first mirror-symmetric internal plane and an internal principal symmetry axis and comprising a piece magnet having two opposite poles, the piece exhibiting a second mirror-symmetric body plane and a second internal principal symmetric axis, the first plane coinciding with the second plane, the first axis coinciding with the second axis, one pole of said piece magnet being located in said first half in a preselected number of pieces, the other pole of said piece magnet being located in said second half in the remaining pieces, a portion of the pieces with the first mirror-symmetric half oriented away from the board being provided for one player, the remaining pieces having their second mirror-symmetric half oriented away from the board and being provided for another player, an improvement comprising:

each playing piece being substantially spherical and adapted to automatically flip in a cavity in which a piece magnet pole encounters an opposite pole of a board magnet in said cavity;

each playing square having a recession therein adapted to receive a playing piece, said recessions having walls of spherical curvature;

the board magnets being asymmetrically and removably positioned and located only in at least a portion of said cavities;

the position of the board magnets with respect to a player located at an edge of a surface being changeable by rotating the board to another edge whereby an increased element of change is present in the game.

* * * * *